US009995182B2

(12) United States Patent
Scholz

(10) Patent No.: US 9,995,182 B2
(45) Date of Patent: Jun. 12, 2018

(54) INSTALLATION SUPPORT STRUCTURE FOR A STEAM CONDENSATION SYSTEM

(71) Applicant: ENEXIO GERMANY GMBH, Herne (DE)

(72) Inventor: Alexander Scholz, Dinslaken (DE)

(73) Assignee: ENEXIO GERMANY GMBH, Herne (DE)

( * ) Notice: Subject to any disclaimer, the term of this patent is extended or adjusted under 35 U.S.C. 154(b) by 0 days. days.

(21) Appl. No.: 15/515,497

(22) PCT Filed: Sep. 29, 2014

(86) PCT No.: PCT/DE2014/100345
§ 371 (c)(1),
(2) Date: Mar. 29, 2017

(87) PCT Pub. No.: WO2016/050228
PCT Pub. Date: Apr. 7, 2016

(65) Prior Publication Data
US 2017/0234168 A1 Aug. 17, 2017

(51) Int. Cl.
*F01K 9/00* (2006.01)
*F28B 1/06* (2006.01)

(52) U.S. Cl.
CPC ..... *F01K 9/003* (2013.01); *F28B 1/06* (2013.01)

(58) Field of Classification Search
CPC .. F28B 1/06; F28F 9/013; F01K 9/003; E04H 5/12
See application file for complete search history.

(56) References Cited

U.S. PATENT DOCUMENTS 3,707,185 A 12/1972 Modine et al.
8,235,363 B2 8/2012 Samyn et al.

FOREIGN PATENT DOCUMENTS

DE 19937800 A1 2/2001
DE 10323791 A1 12/2004
DE 102007012539 B4 3/2011

OTHER PUBLICATIONS

International Search Report, dated Jun. 12, 2015 in PCT/DE2014/100345, 11 pages.

*Primary Examiner* — Jonathan Matthias
(74) *Attorney, Agent, or Firm* — Hauptman Ham, LLP

(57) ABSTRACT

A support structure for a condensation system is disclosed having a pair of tube bundles connected at its respective upper ends to steam distribution lines for introducing steam into the tube bundles. The lower ends of the tube bundles are connected to condensate collectors for receiving condensate from the tube bundles and the tube bundles are arranged in a V shape such that the steam distribution lines of a pair of tube bundles are further apart from one another than are the condensate collectors of the pair of tube bundles.

16 Claims, 11 Drawing Sheets

INSTALLATION SUPPORT STRUCTURE FOR A STEAM CONDENSATION SYSTEM

CROSS REFERENCE TO RELATED APPLICATIONS

The present application is a National Phase of International Application Number PCT/DE2014/100345, filed Sep. 29, 2014.

BACKGROUND OF THE INVENTION

1. Field of the Invention

The present invention relates to a support structure for a steam condensation system and installation of the support structure.

2. Description of the Related Art

Installations for condensing turbine or process exhaust steam have already been used for many years in very large dimensions in the energy technology sector (DE 199 37 800 A1). Air-cooled condensers serve for the direct condensation of turbine exhaust steam. They can be considered to be a special usage case of air-cooled heat exchangers. Air-cooled heat exchangers serve for cooling fluids by means of ambient air in various processes in the chemical, petrochemical and electricity generation industries. The heat exchangers are composed substantially of heat exchanger tubes which, owing to the poor thermal conductivity of the air, are provided with fins on the outer side in order to improve the heat transfer. The heat transfer to the cooling medium, air, by means of heat exchangers by heat conduction and convection is commonly also referred to as dry cooling. The heat exchanger tubes of air-cooled heat exchangers are combined to form so-called bundles by being welded into planar, perforated, thick-walled metal sheets, also referred to as tube plates. Said bundles are referred to as fin-tube bundles or tube bundles.

The inflow of the fluid to be cooled into the heat exchanger tubes is realized by means of steam distribution lines which are welded to the tube plates at the top. The outflow of the condensate and the distribution of excess steam is realized by means of condensate collectors which are welded to the tube plates at the bottom.

The cooling medium, air, is conveyed through the heat exchanger bundle by means of fans which are arranged so as to impart a suction or pressure action. A common type of construction is the so-called roof type of construction. In the case of this arrangement, fans are situated, in an arrangement for imparting a pressure action, below heat exchanger bundles arranged in roof-shaped fashion. The heat exchanger bundles arranged in roof-shaped fashion with the fans are borne by a support structure, wherein the fans are borne by a fan bridge.

The adaptation of air-cooled condensation installations to the quantity of exhaust steam or turbine size and to the operating and ambient conditions (air temperature) may basically be realized through variation of the heat exchanger surface area and/or through variation of the cooling air flow.

For the delivery of the cooling air, it is the case in all air-cooled heat exchangers for industrial applications that fans of axial type of construction are used, because these are suitable for delivering the required large volume flows with low pressure differences.

If multiple heat exchanger bundles are assigned to one or more fans such that the heat flow transferred by the heat exchanger bundles and the cooling air volume flow that absorbs said heat are in equilibrium, there is, depending on the type of construction, a basic geometric pattern which is also referred to as module. If the modules or cells are arranged in series (series connection), so-called multi-cell, single-row installations are realized. Owing to the supply of air from below, cells or modules of roof type of construction may also be produced through parallel connection of multiple roof rows of air-cooled condensers of virtually any desired size.

The major advantage of the roof type of construction consists in the possibility of producing even very large installations by way of the parallel and series connection of the individual cells. The fans arranged below the heat exchanger bundles must, however, in the case of the roof type of construction, be equipped with protective grilles for the purposes of protection against falling parts or damage to the fan. Furthermore, the fan ring, which is arranged around the fan for the purposes of realizing defined flow conditions, reduces the air inlet height. As a result, the support structure on which the heat exchanger bundles lie must be correspondingly elevated.

A further disadvantage may arise as a result of the recirculation of the heated cooling air. Owing to the low hot-air speeds in the case of the roof type of construction of the condensers, a so-called wind wall must be installed around the outer heat exchanger elements, which are composed of an additional support structure with wind wall panels.

Furthermore, in the case of the roof type of construction, it is necessary to provide encircling access means for permitting cleaning of the heat exchanger elements.

Heat exchanger bundles in a V-shaped arrangement with fans situated at the top can be erected with a small structural height, but in the case of heat exchanger bundles which are not self-supporting, very cumbersome support structures are required (DE 103 23 791 A1). Heat exchangers of V-shaped type of construction are therefore usually used only in the field of process coolers with horizontally arranged heat exchangers (water return coolers, air-conditioning technology). There, the structural sizes are significantly smaller, whereby the support structure for the V-shaped arrangement can be made economically. The fans are also correspondingly smaller and lighter. In the case of relatively large installations, the support structure is however always relatively cumbersome, and has hitherto proven to be uneconomical.

DE 10 2007 012 539 B4 discloses, in the case of fans situated at the bottom and heat exchanger elements arranged in roof-shaped fashion thereabove, the mounting of a frame-like fan panel on a reduced number of supports in order to reduce the outlay with regard to the steel structure. Below each fan panel, there is provided at least one support in the form of a column running vertically to the fan panels, wherein, above the column, there are adjoining head struts which run obliquely relative to the fan panel and the column and which extend to the corners of a fan panel. The fans themselves are mounted on or on top of the fan panels.

U.S. Pat. No. 8,235,363 B2 discloses as prior art a heat exchanger arrangement in which a cooling tower is assembled from heat exchanger bundles, in particular in a hexagonal arrangement. The fan is situated above the bundles. Several of these tower modules may be arranged adjacent to one another. The surfaces of adjacently arranged modules which are in contact however do not participate in the exchange of heat. The fan is mounted on a central pillar. At the upper end of the tower there is situated a bridge which is supported by means of end-side support pillars on the ground. The support structure thus takes the form of a bridge with three pillars. It is a disadvantage that, for each individual module, a relatively cumbersome steel structure and a highly complex steam distribution line are required. For each individual cell, three foundations for the three supports are required. Furthermore, a series and parallel connection of the individual modules for the purposes of erecting relatively large installations is not possible.

SUMMARY OF THE INVENTION

Taking the prior art as a starting point, it is the object of the invention to specify an installation for condensing steam for all turbine sizes, which installation permits, with regard to the bearing support frame, a reduction in material usage and a reduction in assembly outlay.

Said object is achieved by means of an installation for condensing steam having the features of patent claim 1.

Advantageous refinements of the invention are the subject of the subclaims.

The installation according to the invention for condensing steam comprises tube bundles which are connected by means of their upper ends to steam distribution lines and are connected by means of their lower ends to condensate collectors. The tube bundles are thus flowed through by steam from top to bottom. Here, the tube bundles are arranged in V-shaped fashion, such that the steam distribution lines of a pair of tube bundles run with a greater spacing to one another than the condensate collectors of the pair of tube bundles, which are arranged in the region of a lower vertex of the V-shaped arrangement.

Above the pair of tube bundles, at least one fan is arranged in the region between the steam distribution lines. The basic geometric pattern composed of tube bundles arranged in a V shape, the fans arranged above the pair of tube bundles, the associated steam distribution lines in the upper region and the condensate collectors in the lower region will hereinafter also be referred to as cell or module. This is a unit in which the heat flow transferred from the bundles and the cooling-air volume flow that absorbs said heat are in equilibrium.

A special feature is that the fan is borne by a central support pillar which extends from the fan to the vertex. That is to say, the central support pillar extends through the interior space which is triangular in cross section and which widens from bottom to top in the direction of the fan.

The tube bundles themselves are mounted on a support bracket which extends in the longitudinal direction of the vertex and which is connected to the central support pillar. The central support pillar thus accommodates not only the load of the fan but, via the support brackets, also the load of the tube bundles and of the support brackets themselves.

Furthermore, the tube bundles are self-supporting. This means that the tube bundles do not require any additional support structure to support the tube bundles for example against sagging. It is sufficient for the tube bundles to have a free support in the region of their lower end, that is to say in the region of the vertex, and furthermore be fixed in the region of their upper ends. Mutually adjacent tube bundles may for example be connected to one another via a common steam distribution line.

The fan is a relatively heavy component, wherein, in the context of the invention, a fan is to be understood to mean both the drive unit and the gearing unit connected thereto and the fan blades themselves. Said fan unit makes up a considerable part of the overall weight of the condensing installation. To relieve the tube bundles of load, the weight of the fans is however not transmitted via a fan bracket or fan platform which is in turn mounted on the tube bundles, it rather being the case that the weight is introduced directly into the support pillar. The support pillar itself is the central bearing component which, via the support brackets, additionally accommodates the weight of the self-supporting tube bundles. In addition to this there is the weight of the condensate collectors and of the steam distribution lines, which are arranged on the top side and bottom side, respectively, of the tube bundles.

Altogether, the entire weight of such a cell or of such a module can be dissipated via a single support pillar into the placement surface, in particular the ground. It is not necessary for a multiplicity of foundations or supports to be provided per cell. It must be taken into consideration that, in general, multiple such modules are used in a series or parallel connection configuration. The cells or modules may therefore be supported laterally against one another. Relatively large installations also achieve their stability by means of the multiplicity of modules or cells and the multiplicity of central support pillars. Units of at least four modules are preferably installed in a square arrangement.

The force of the weight of the fan or of the fan arrangement can be dissipated in a particularly effective manner if the central support pillar extends vertically below the fan as far as the support bracket. The invention does not rule out a situation in which the central support pillar extends downward from the fan eccentrically for reasons relating to air guidance or statical or design reasons, but the central solution is considered to be the most expedient.

The central support pillar preferably also has a lower section which is continued below the support bracket as far as the placement surface of the installation. The support pillar therefore has two sections which are loaded with different intensity. The upper section within the triangular-prism-shaped region delimited by the tube bundles bears the fan or the fan arrangement. The lower section of the central support pillar additionally bears the weight of the tube bundles and of the inlet and outlet lines. In order that the entire arrangement remains in equilibrium, the arrangement is arranged preferably symmetrically with respect to the central support pillar. That is to say, the support brackets are preferably of equal length.

In the case of an arrangement of at least three rows of modules, it is possible for crossmembers to be provided which run transversely with respect to the rows. The modules are mounted on the crossmembers. The crossmembers are in this case preferably borne by the lower sections of the central support pillars.

The crossmembers are dimensioned and arranged such that a required number of support pillars with a lower length section projecting as far as the placement surface is smaller than a total number of support pillars provided. For example, the connection between the crossmembers and the placement surface via the support pillars may be realized only for every second row of modules. If the support pillars which project as far as the placement surface are not the support pillars of the rows at the edges, then it is for example possible for five rows of modules to be mounted on two support pillars below the second and fourth rows. In the case of a number of n rows, it is consequently the case that n−3 support pillars are sufficient for the support on the placement surface.

The invention however does not exclude a situation in which a crossmember is borne by crossmember supports which are not congruent with the lower length sections of the central supports. Such crossmember supports which are offset relative to the longitudinal axes of the central supports may be provided in addition or alternatively to lower sections of the central supports. The number of crossmember supports is preferably smaller than the number of central supports of the modules.

It is considered to be particularly expedient if, in the case of multiple rows of tube bundles in a V-shaped arrangement, mutually adjacent tube bundles are connected by means of their upper ends to a common steam distribution line. In this way, the individual cells can be positioned closer together. The tube bundles are supported against one another in a horizontal direction. No additional vertical support of the steam distribution lines is necessary. Thermally induced changes in length of the bundles can be easily compensated.

The mutually adjacent tube bundles may also be referred to as a roof-shaped arrangement or roof row. The respectively outer tube bundles are not supported at an outer side by a further tube bundle. They may be connected by means of struts to the respectively adjacent inner tube bundle. Tensile and compressive forces are dissipated via the adjacent cell by means of the struts.

The outer tube bundles are connected to dedicated steam distribution lines. The cross sections of the outer rows of the steam distribution lines may be selected to be smaller than the cross sections of the inner steam distribution lines.

The sealing and support of a fan ring which surrounds the fan is realized by means of a secondary support structure. The secondary support structure bears and comprises in particular closed walls. These form, in effect, the face-side or gable-side closure of the V-shaped arrangement of tube bundles. The secondary support structure comprises in particular a framework composed of individual struts. Said secondary support structure is of self-supporting design. It is in turn supported on top of or on the primary support structure, specifically on the support brackets thereof. The primary support structure also includes the central support pillar. For the secondary support structure, the support pillar serves in particular for centering in a horizontal direction in order that the fan ring is arranged concentrically with respect to the fan. Said secondary support structure does not bear the load of the tube bundles but rather serves primarily for sealing off the triangular-prism-shaped interior space and creating a base on which the fan ring is mounted. The secondary support structure may be a framework structure in which the struts have the bearing function and cladding elements arranged thereon have a sealing function. It is however also possible for the secondary support structure to have self-supporting areal bearing elements, composed for example of fiber-reinforced plastics, in particular of glass-fiber-reinforced plastics. The fan ring may be composed of the same material as the bearing elements. It may be a materially integral constituent part of a fan cowl which forms the upper termination of the cell. The triangular side walls may have maintenance openings.

Since such installations for condensing steam are generally used only in combination with power plants or correspondingly large industrial plants, it is generally the case that multiple modules are combined with one another to form an entire condensation installation. The modular construction thus makes it possible for particular loads to be accommodated differently than would be possible with a single module. In an advantageous refinement, it is therefore provided that support pillars which are adjacent in a longitudinal direction of the vertex and/or support pillars of mutually adjacent V-shaped tube rows run, below the support brackets and at least over a subregion of their length, at an angle which deviates from 90° with respect to a horizontal plane. In other words, the respective central support pillar is duly extended with its lower section as far as the base or as far as the ground, but does not imperatively have a vertical profile.

It is possible for support pillars of a single vertex, that is to say of a single row, to be moved so close together that they can be mounted on a common foundation. It is however also conceivable for mutually adjacent support pillars of different rows of V-shaped arrangements to converge on one another and likewise be mounted on a common foundation. It is thus possible for groups of in each case two support pillars or even groups of four support pillars to be combined with one another and mounted on a common foundation. In particular in the case of the modules being provided in a square arrangement, it is thus possible for the outlay for the mounting of the condenser arrangement as a whole to be reduced under certain conditions.

If the foundations or free supports are not arranged vertically below the fans, horizontal forces arise which must be absorbed. For this purpose, it is possible for adjacent support pillars and/or tube bundles and/or support brackets to be connected to one another by means of struts. The exact arrangement arises from the magnitude and orientation of the horizontal forces and ultimately also from the design and position of the support pillars and foundations.

The support bracket is in particular a cantilevered projecting arm which is attached to the support pillar, similarly to a branch on a trunk. The support bracket itself is not additionally supported relative to the placement surface. The forces that are supported on the bearing brackets are accommodated, and dissipated downward, exclusively via the central support pillar. To reduce the torque load in the region of the region of attachment to the support pillar, it is possible for bearing means, in particular in the form of cables or rods, to be provided, which are fastened in particular to the distal ends of the support bracket and extend from the upper end of the support pillar to the support bracket situated at a lower level.

The support pillars and/or the support brackets may be formed at least partially by lattice girders. The support pillar may, owing to its load profile, be configured differently in its upper section than in its lower section.

The support pillar may be at least partially of tubular form. It may be a concrete support tube or else may be a tube composed of steel. Tubular support pillars have the advantage that the support pillar itself can form a duct for conducting cooling air from bottom to top to a drive unit of the fan. In the case of support pillars in the form of lattice girders, ducts can be installed in the lattice structure for the purposes of conducting the cooling air from bottom to top to a drive unit of the fan in the same way. Furthermore, a blower may be provided for conveying the cooling air through the duct in the support pillar by suction or pressure action.

A blower of said type is required only if the suction pressure of the fan is not sufficient.

In the context of the invention, it is conceivable for a gearing and a drive for the fan to be arranged below the support brackets, that is to say below the free support of the tube bundles within or on the central support pillar, and to be connected to the fan by means of a very long drive shaft.

In the case of a central support of the fan assembly, the central support pillar allows direct access for the purposes of maintenance of the fan assembly. Tubular or pylon-like support pillars may be equipped with a corresponding climbing aid.

An accessible cleaning platform may be installed in the region of the vertex such that the individual tube bundles are easily accessible and can be easily maintained.

The construction on which the invention is based, and the combination of heat exchangers arranged in a V shape in multiple rows, make it possible for installations for condensing steam, with the fans arranged so as to impart a suction action, to be produced particularly economically in all required sizes.

Through the creation of additional air induction areas, a significant lowering of the required air inlet height and thus a less-expensive support structure are made possible in comparison to the roof type of construction with fans arranged at the bottom.

The smaller structural height furthermore has the effect that the lengths of the steam-conducting pipelines are reduced. Because very large line cross sections are used here, this difference is significant.

Owing to the omission of protective fan grilles and fan bearing bridges in relation to the roof type of construction (roof-type condenser), lower pressure losses are generated on the air side, resulting in a relatively low power requirement of the installation.

The omission of the wind wall and of the fan bearing bridge in relation to the roof-type construction reduces the material requirement for the installation. In this way, the number of parts of the installation and thus also the outlay in terms of design and assembly are also reduced.

Owing to the arrangement of the central support pillar, the material outlay for the primary support structure and for the support of the fans is further reduced.

By means of the self-supporting tube bundles connected to one another merely by way of struts, it is possible to dispense with an otherwise required support structure with V-shaped arrangement of vertical tube bundles.

Owing to the omission of the fan bearing bridge, more uniform flow conditions for the fan and more optimum working conditions are realized, which result in reduced wear of the fans and gearing.

By means of the arrangement on which the invention is based with a central support pillar, the placement surface of the installation is reduced.

BRIEF DESCRIPTION OF THE DRAWINGS

The present invention will now be described, by way of example, with reference to the accompanying drawings, in which.

In the figures, the same reference designations are used for identical or similar components, even if a repeated description is omitted for reasons of simplicity.

DETAILED DESCRIPTION OF SOME EMBODIMENTS

Figure 1:
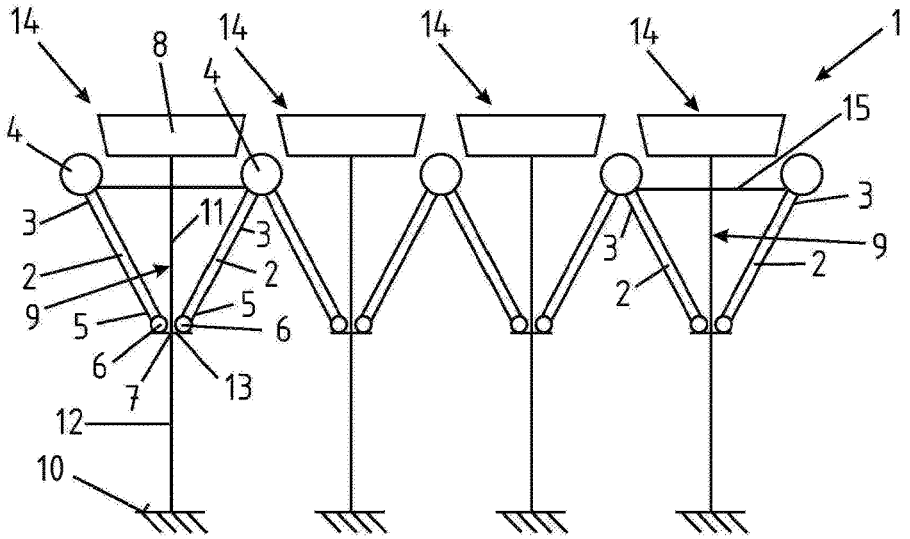
FIG. 1 shows an installation for condensing steam in a first side view.

FIG. 1 shows an installation 1 for condensing steam. The installation 1 is illustrated merely schematically and is intended merely to illustrate the design principle. The installation 1 comprises tube bundles 2 which are connected by means of their upper ends 3 to steam distribution lines 4. By means of their lower ends 5, the tube lines 2 are each connected to condensate collectors 6. The tube bundles 2 are arranged in a V shape, such that the steam distribution lines 4 of a pair of tube bundles 2 run with a greater horizontal spacing to one another than the condensate collectors 6. In the illustration of FIG. 1, the condensate collectors 6 extend into the plane of the drawing in the longitudinal direction of a lower vertex 7. At least one fan 8 is arranged, above the pair of tube bundles 2, in the region between the steam distribution lines 4. "Between the steam distribution lines" does not mean that the fan 8 must imperatively be situated at the same height as the steam distribution lines 4. However, it can be seen in the plan view (FIG. 3) that, as viewed in the projection onto a placement surface, an individual fan 8 is always situated between the steam distribution lines 4.

The fan 8 is mounted on a central support pillar 9 which extends from the fan 8 to the vertex 7. The support pillar 9 extends beyond the lower ends 5 and the condensate collectors 6 in the direction of a placement surface 10 on which the support pillar 9 is mounted. An upper section 11 of the support pillar 9 consequently bears substantially the fan 8 or a fan assembly comprising a fan gearing (not illustrated in any more detail) and a fan drive unit. A lower section 12 of the support pillar 9 additionally bears the tube bundles 2 which are mounted on support brackets 13 which extend in the longitudinal direction of the vertex 7.

The support brackets 13 are narrow, and are only as wide as necessary. The support brackets 13 serve only for accommodating the forces from the tube bundles 2 and the lines connected thereto, specifically the steam distribution line 4 and the condensate collectors 6. At the height of the support bracket 13, there is no closed platform as in the case of the roof type of construction.

Such a unit composed of heat exchanger and fan will hereinafter be referred to as module 14. FIG. 1 shows multiple modules 14 of identical design. In this exemplary embodiment, there are four modules 14. The arrangement may also be referred to as a VVVV arrangement, which may be continued in this form to any desired extent.

Figure 3:
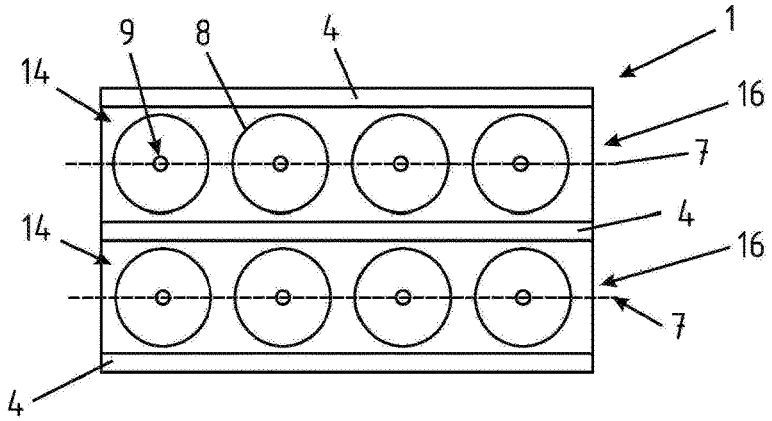
FIG. 3 shows an installation for condensing steam in a plan view.

FIG. 3 shows, in a second side view, a situation in which four such modules 14 are connected in series with one another and are fed via a common steam distribution line 4.

The steam distribution lines 4 running between two modules 14 provide a supply to each of the mutually adjacent tube bundles 2 (FIG. 1). The adjacent tube bundles 2 are arranged in A-shaped or roof-shaped fashion in said region. Said tube bundles are connected to one another at the steam side. In the region of the lower ends 5, the individual tube bundles 2 however open into separate condensate collectors 6. Only the tube bundles at the edges are connected via dedicated steam distribution lines 4 to the steam supply. FIG. 1 furthermore shows that, for statical reasons, the tube bundles 2 at the edges are connected, in the region of their upper ends 3, via horizontally acting struts 15 to the adjacent tube bundle 2. In this way, the outer tube bundles 2 are fixed. By contrast, the inner tube bundles 2 do not need to be braced relative to one another. They rest against one another, and in particular, are coupled to one another by means of their tube plates (not illustrated in any more detail) in the region of the steam distribution lines 4.

Figure 2:
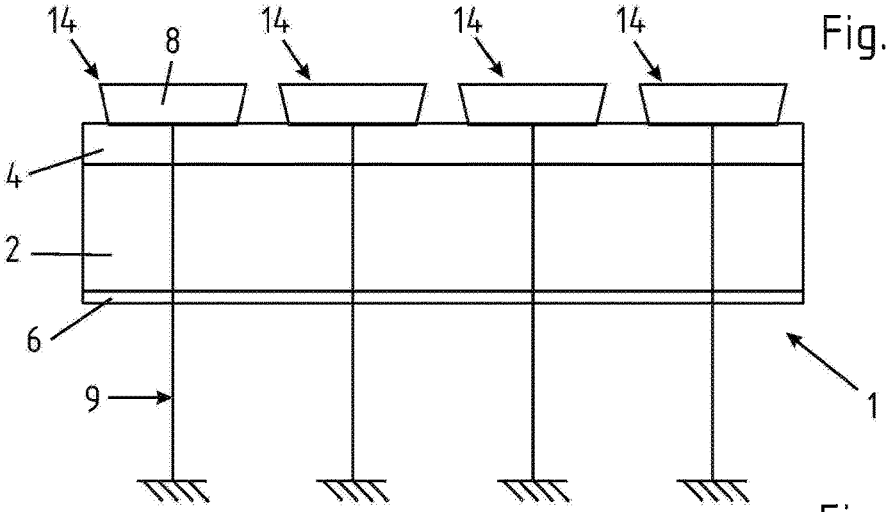
FIG. 2 shows the installation of FIG. 1 in a second view.

FIG. 2 shows the arrangement of FIG. 1 from the side. Altogether, FIG. 1 thus involves an arrangement of 4×4 modules 14. By way of example, two rows 16 of modules 14 are illustrated in FIG. 3. The number of rows 16 may be increased, as may the length of the rows 16 in the direction of the vertex 7.

It can be seen that the central supports 9 are, in the region of the vertex 7, arranged vertically below the fans 8 and, correspondingly to the number of modules 14, only 8 support pillars 9 are required to support the entire installation 1.

The reference signs introduced with regard to FIGS. 1 to 3 will also be used in the further figures to denote functionally identical components.

Figure 4:
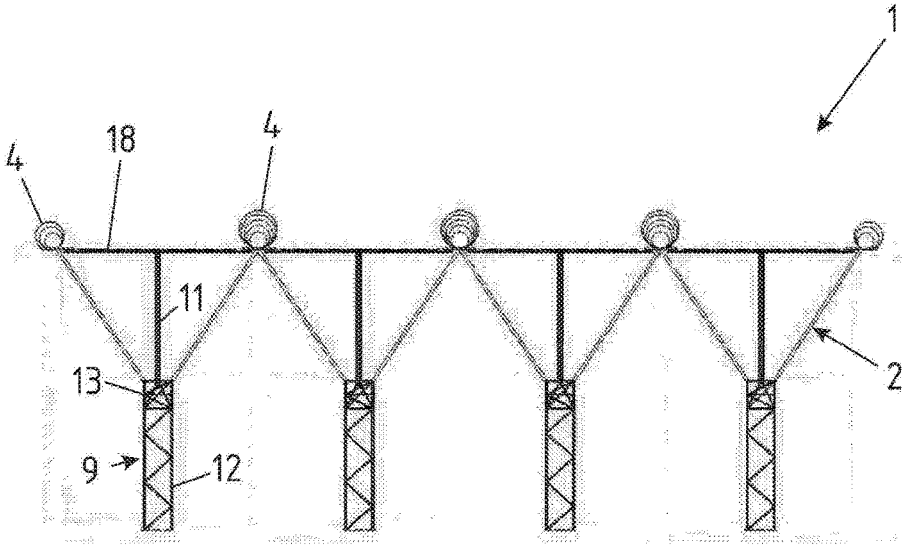
FIG. 4 shows a further embodiment of an installation for condensing steam in a first side view.
Figure 5:
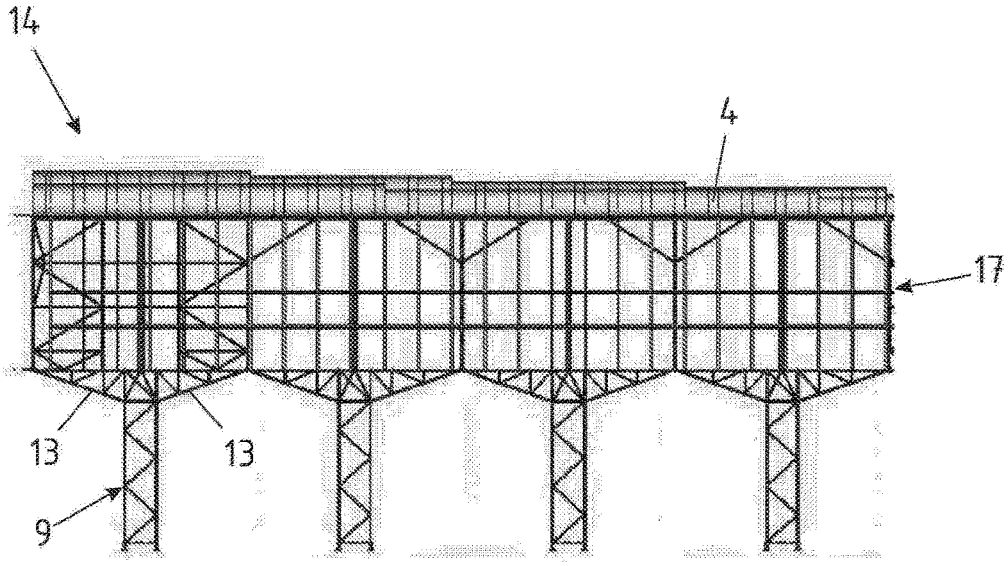
FIG. 5 shows the installation of FIG. 4 in a second side view.

FIGS. 4 and 5 show further details of a possible embodiment of a condensing installation. By contrast to FIGS. 1 to 3, the tube bundles have not been illustrated, and instead, a secondary support structure 17 is illustrated, which will be discussed below on the basis of FIGS. 6 and 7.

The construction of the installation 1 in FIG. 4 is very similar to that of FIGS. 1 and 2. The figure shows support pillars 9 with a lower section 12 in each case in the form of a lattice girder. The lower section 12 is adjoined by the upper section 11 which extends in the form of a central tube as far as a fan base 18, which is a constituent part of the secondary support structure 17. The steam distribution lines 4 are situated above the fan base 18.

It can be seen from FIG. 5 that the diameter of the steam distribution lines 4 decreases in stepped fashion in one direction. Steam is progressively dissipated downward via the individual tube bundles 2. Consequently, the cross section of the steam distribution lines 4 can also be reduced in continuous or stepped fashion. The illustration from a side elevation in FIG. 5 shows that the support brackets 13 of an individual module 14 are configured identically and are in the form of a lattice girder. They point diametrically along the vertex 7. They are situated below the secondary support structure 17 which extends above the support brackets 13 as far as the steam distribution lines 4.

Figure 6:
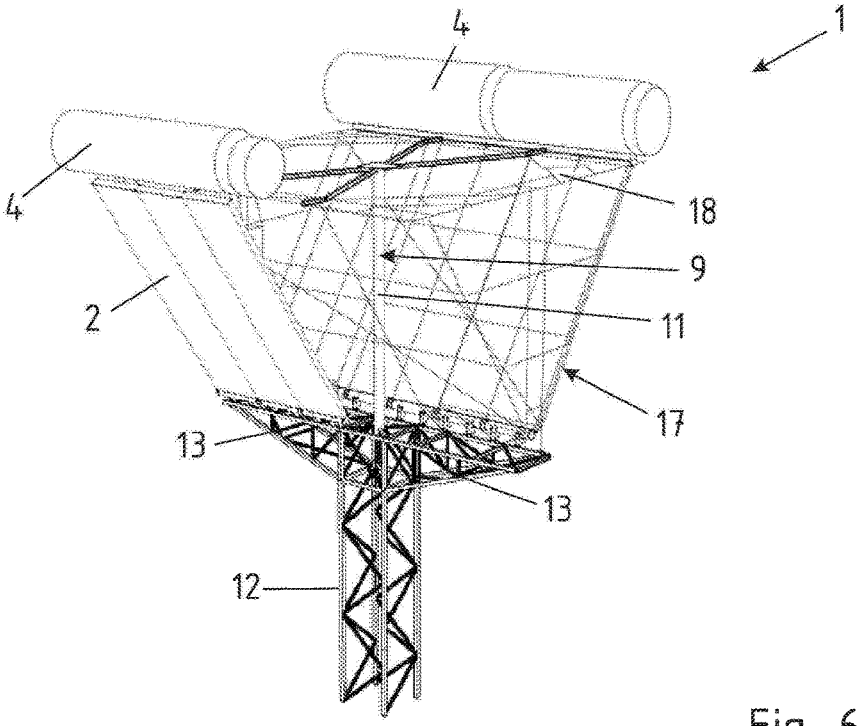
FIG. 6 shows an individual module of the installation of FIG. 4 in a perspective view.

FIG. 6 shows the construction of the secondary support structure 17. The latter surrounds the triangular-prism-shaped interior space of the module 14. Two limbs of the secondary support structure 17 run parallel to the tube bundles 2. The limbs bear a fan base 18 which forms the upper termination of the secondary support structure 17. The triangular face sides of the interior space are likewise spanned by the secondary support structure 17 of lattice type of construction.

The fan base 18 bears a fan ring (not illustrated in any more detail) which surrounds the fan blades of the fan for the purposes of air guidance. Altogether, the entire module 14 as illustrated in FIG. 6 is composed of self-supporting components. The secondary support structure 17, with its lattice-like structure and the fan base 18, is self-supporting. The steam distribution lines are mounted on self-supporting tube bundles 2. The front steam distribution line 4 has a smaller diameter than the rear steam distribution line. This is because the rear steam distribution line 4 is provided for providing a supply to tube bundles 2 of a further module. The front steam distribution line 4 provides a supply only to the illustrated tube bundles 2. The support brackets 13 are self-supporting, as is the central support pillar 9. Altogether, it is thus possible with reduced material outlay and a high depth of production to provide preconfigured assemblies which can be installed on site with little installation outlay.

Figure 7:
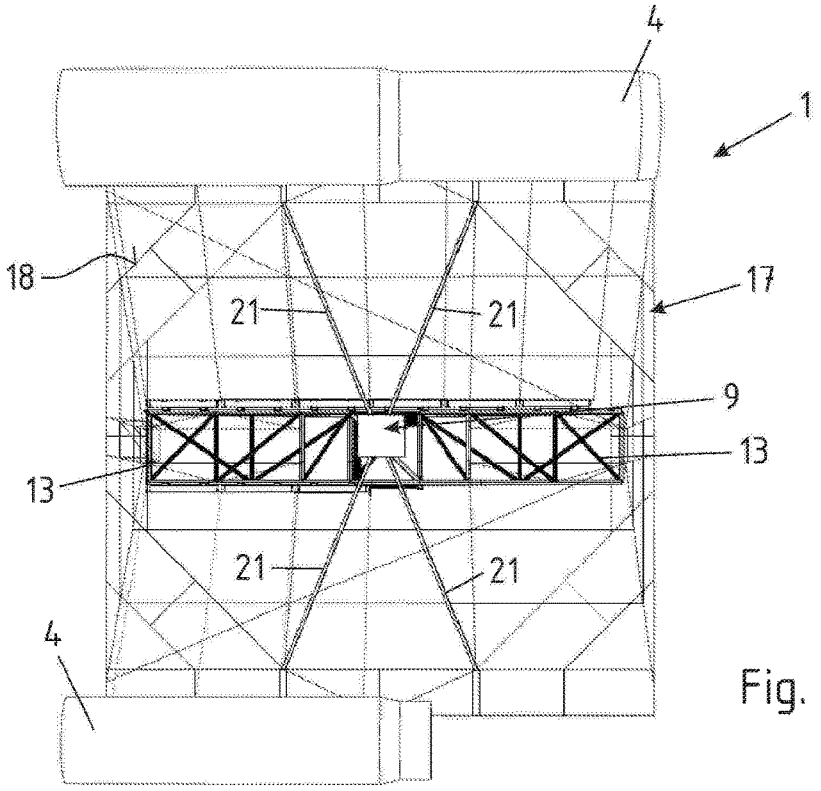
FIG. 7 shows a module of FIG. 6 in a plan view.

FIG. 7 shows the module of FIG. 6 in a plan view. To give a better overview, the lower steam distribution line 4 has been illustrated in shortened form. The fan base 18 has stiffening means in the corner region, and struts 21 which extend from the upper edges of the two limbs to the central support pillar 9. The fan base 18 is centered by means of said struts 21. In a manner not illustrated in any more detail, the secondary support structure 17 is cladded in substantially windproof fashion in the region of its triangular face sides.

Figure 8:
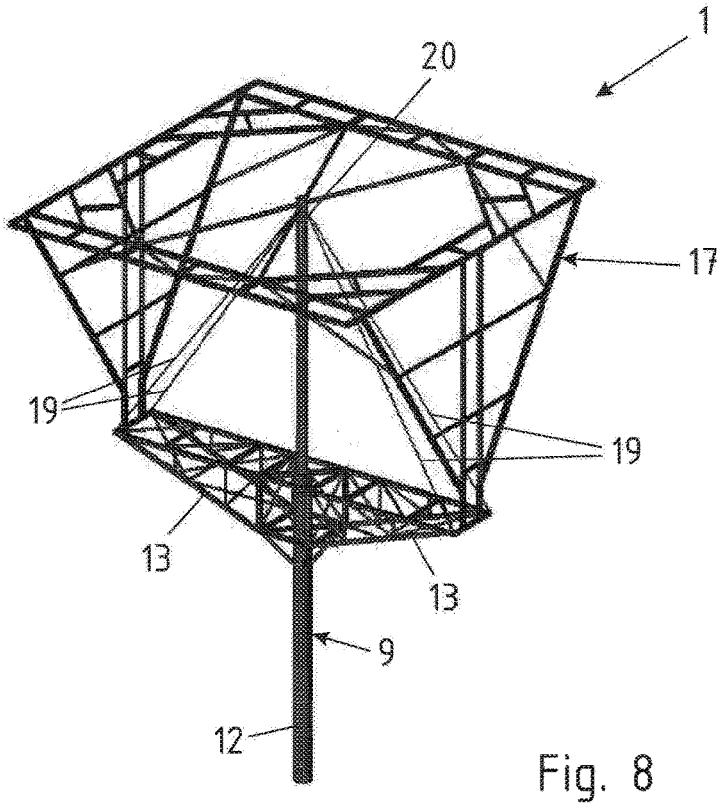
FIG. 8 is a perspective illustration of a further embodiment of a support structure for a module.
Figure 9:
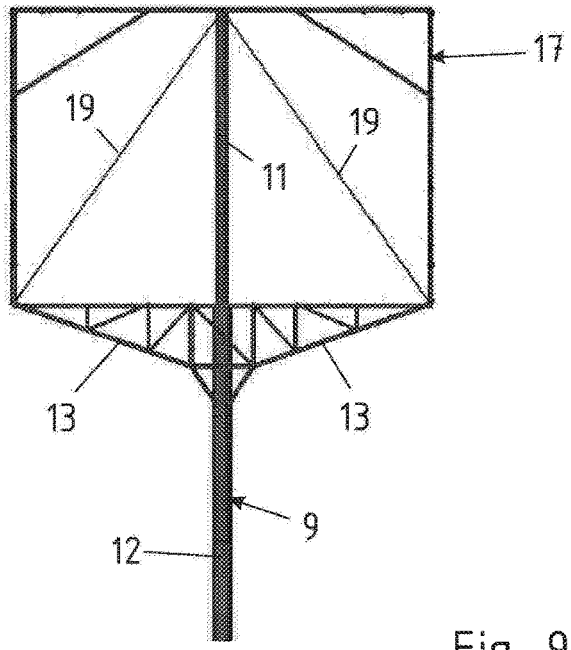
FIG. 9 shows the module of FIG. 8 in a side view.
Figure 10:
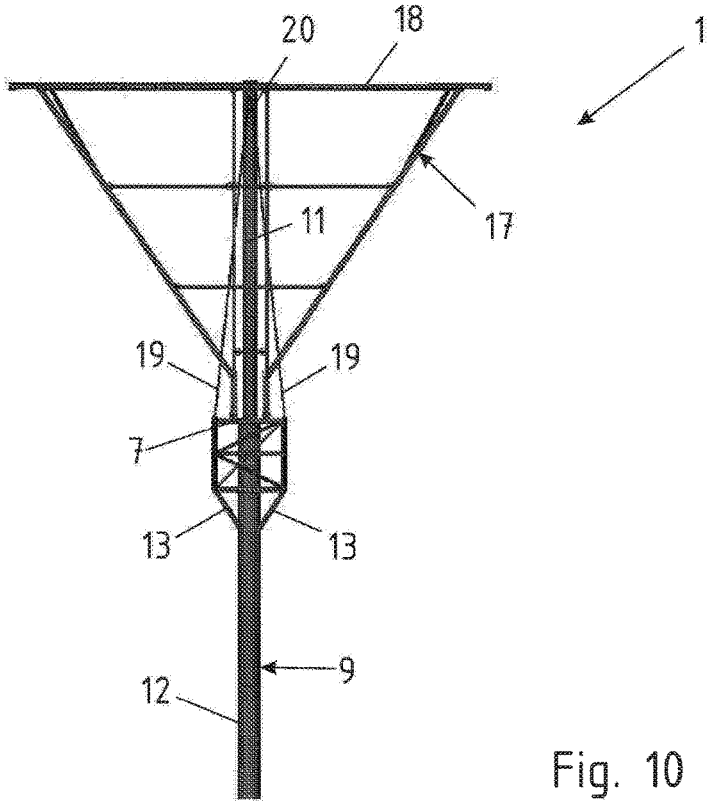
FIG. 10 shows the module of FIGS. 8 and 9 in a further side view.
Figure 11:
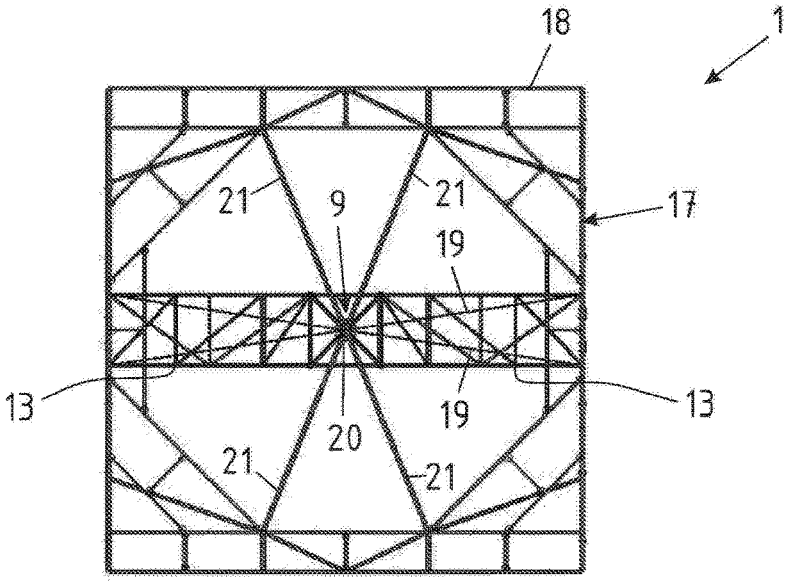
FIG. 11 shows the module of FIGS. 8 to 10 in a plan view.

The exemplary embodiment of FIGS. 8 to 10 differs from that of FIG. 4 in that the central support pillar 9, in its lower section 12, is not in the form of a lattice girder but is tubular. The upper section 11 thereof is also of tubular form. The central support pillar 9 may thus also be referred to as a tubular mast. Owing to the different loading situation, however, there is a step change in diameter above the support brackets 13. The support pillar 9 is designed to be slimmer in its upper section 11 than in its lower section 12. Furthermore, the support brackets 13 are connected by bearing means 19 to an upper end 20 of the support pillar 9. The support brackets 13 are thereby subjected to less bending loading. It is thus possible for the structural height of the support brackets 13 to be reduced, in particular in the region of attachment to the central support pillar 9 (FIG. 9).

FIG. 10 shows, in a further side view, a situation in which in each case two bearing means 19 duly converge in the region of the upper end 20 of the support pillar 9, but in the region of the support brackets 13, are led to the in each case outer corners of the support brackets 13 and thus run spaced apart from the vertex 7. This improves the torsional stiffness of the support brackets 13 in the direction of the vertex 7. The axis of the vertex 7 runs into the plane of the drawing in FIG. 10 and lies at the transition region from the relatively thick lower section 12 of the support pillar 9 to the relatively slim upper section 11 of the support pillar 9.

FIG. 10 diagrammatically shows the construction of the secondary support structure 17, which delimits the substantially triangular-prism-shaped interior space and, in the upper region, bears the fan base 18. In this exemplary embodiment, the fan base 18 is of square configuration and has lattice struts running in the plane of the fan base 18 with diagonal stiffening means in the corner region of the fan base 18. The number of struts is as low as possible in order to keep the air resistance as low as possible. Merely for the purposes of centering the fan base 18 relative to the upper end 20 of the central support pillar 9, there are provided four struts 21 by means of which the fan base 18 is connected to the support pillar 9 in a horizontal direction.

Figure 12:
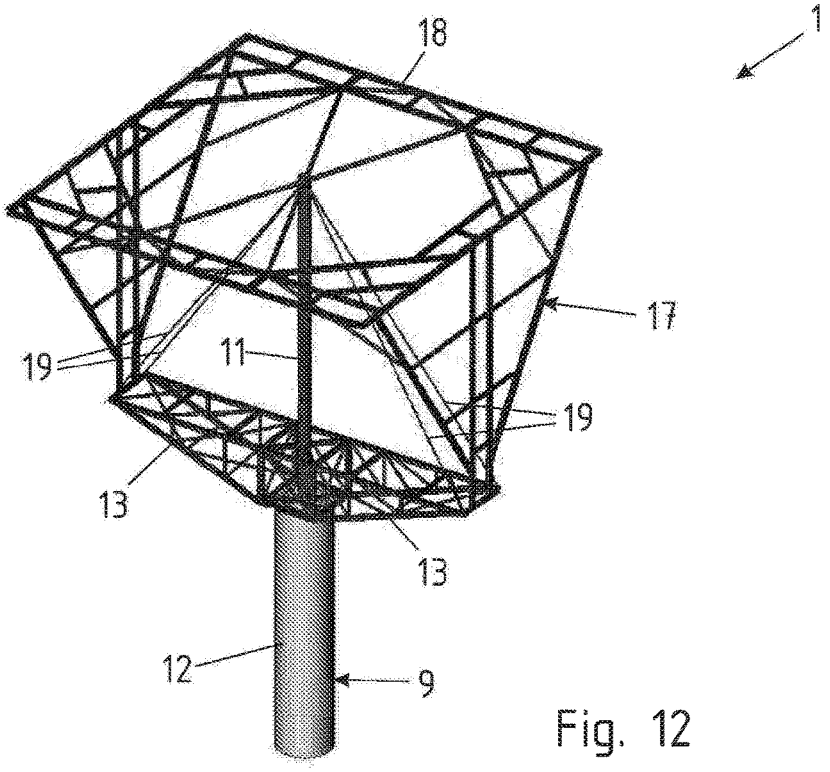
FIG. 12 is a perspective illustration of a further embodiment of an installation for condensing steam.
Figure 13:
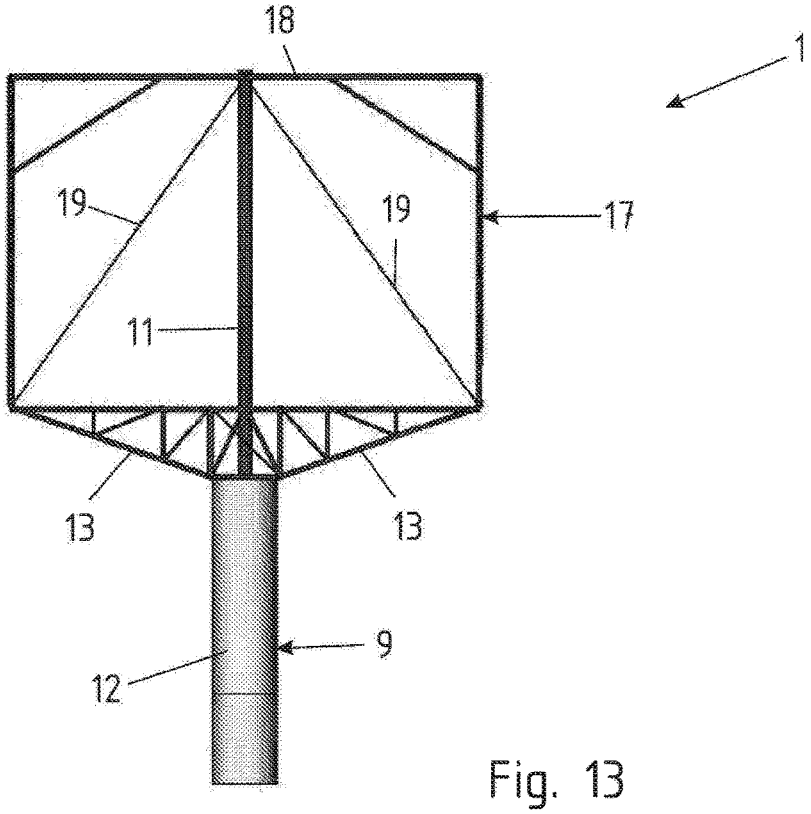
FIG. 13 shows the installation as per FIG. 12 in a side view.

The embodiment of FIG. 12 differs from that of FIGS. 8 to 11 in that the support pillar 9 is, in the region of its lower section 12, in the form of a tube of larger diameter than in the exemplary embodiment of FIG. 8. This may in particular be a concrete tube. Also, by contrast to the exemplary embodiment of FIGS. 8 and 9, said lower section 12 does not extend through the support brackets 13. The support brackets 13 are mounted on the lower section 12. Also, the upper section therefore does not begin only above the support brackets 13, but rather begins at the lower height region of the support brackets 13. This can be attributed to the different material compositions of the support pillar 9. The support pillar 9 is therefore not imperatively a materially integral, unipartite component. It may be of multi-part construction or assembled from different materials. The support pillar 9 may consequently be a hybrid component composed of concrete or reinforced concrete in its lower section 12 and composed of steel in the form of a lattice structure or a tubular structure in its upper section 11. With regard to the bracing means such as can be seen in particular in FIG. 13, reference is made to the explanations of FIGS. 8 to 11.

Figure 14:
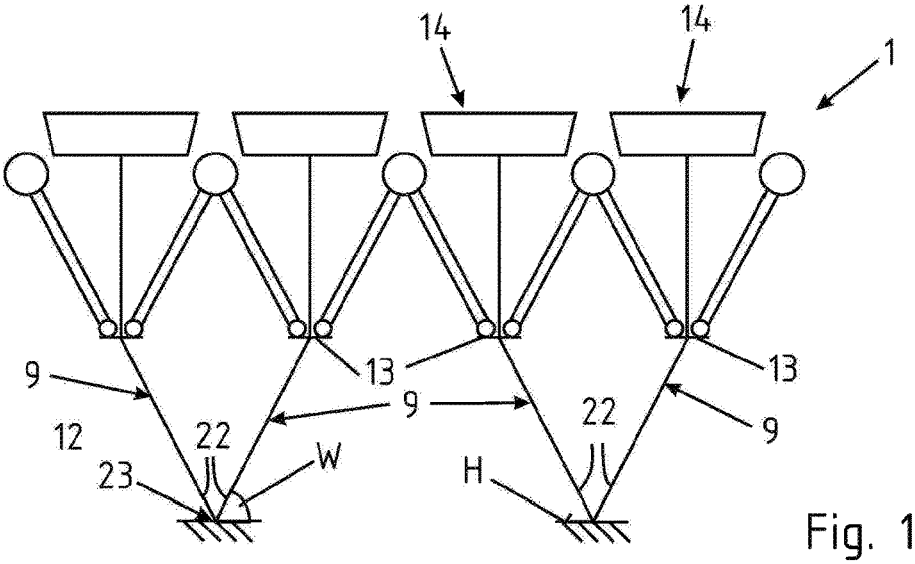
FIG. 14 is a schematic illustration of a further embodiment of an installation for condensing steam in a first side view.
Figure 15:
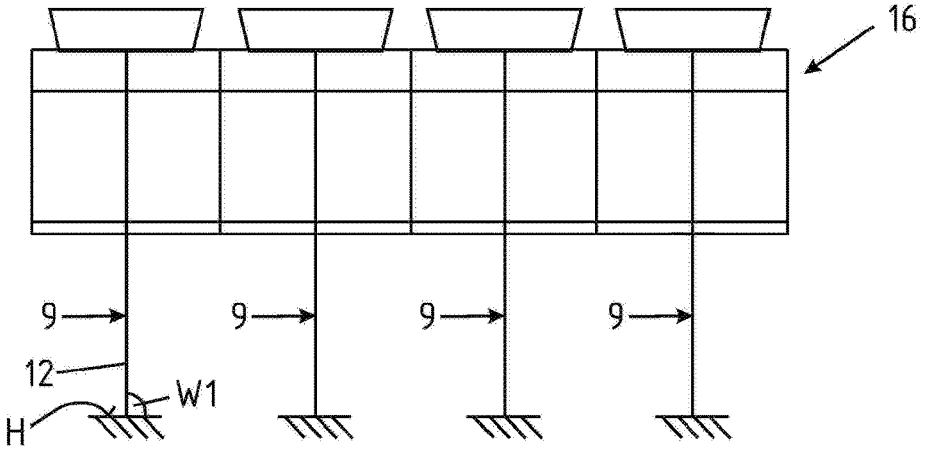
FIG. 15 shows the installation of FIG. 14 in a second view.
Figure 16:
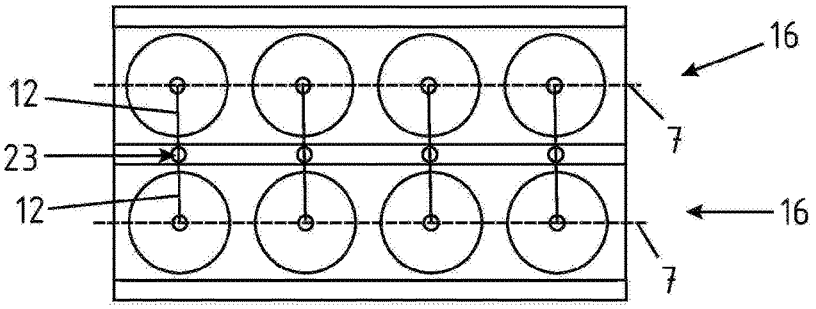
FIG. 16 shows the installations of FIGS. 14 and 15 in a plan view from above.

The exemplary embodiment of FIG. 14 is very similar to that of FIG. 1, such that reference can be made to the reference signs introduced there and the explanation relating thereto. The only difference is that the lower section 12 of the support pillar 9 is arranged at an angle W, which deviates from 90°, with respect to a horizontal plane H. Specifically, the horizontal plane is defined by the placement surface 10 or else by the plane in which the support brackets 13 of the individual modules 14 extend. In this exemplary embodiment, the lower ends 22 of mutually adjacent rows 16 (FIG. 16) are mounted in a common foundation 23. The angle W is in this case measured transversely with respect to the longitudinal extent of the rows 16. FIG. 15 shows that the support pillars 9 are furthermore arranged at an angle W1 of 90° with respect to the horizontal plane H.

Figure 17:
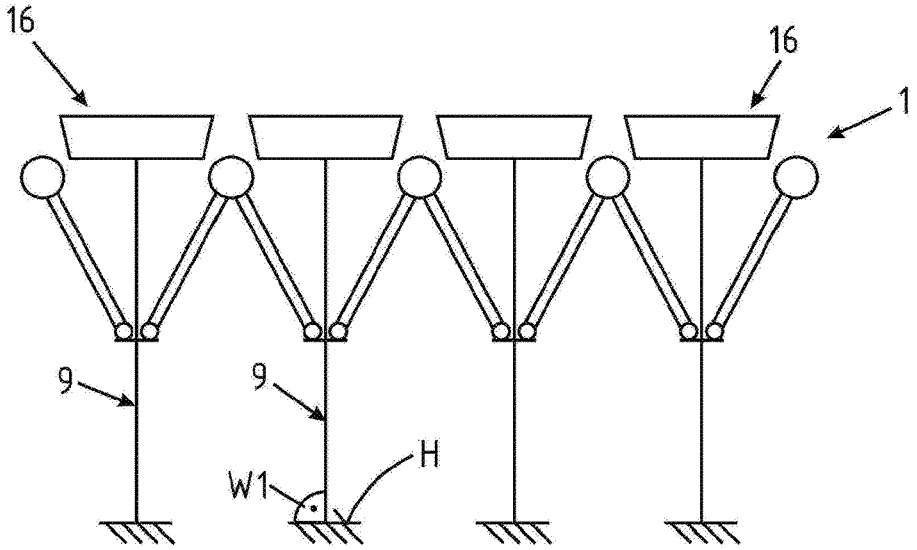
FIG. 17 shows a further embodiment of an installation for condensing steam in a first side view.
Figure 18:
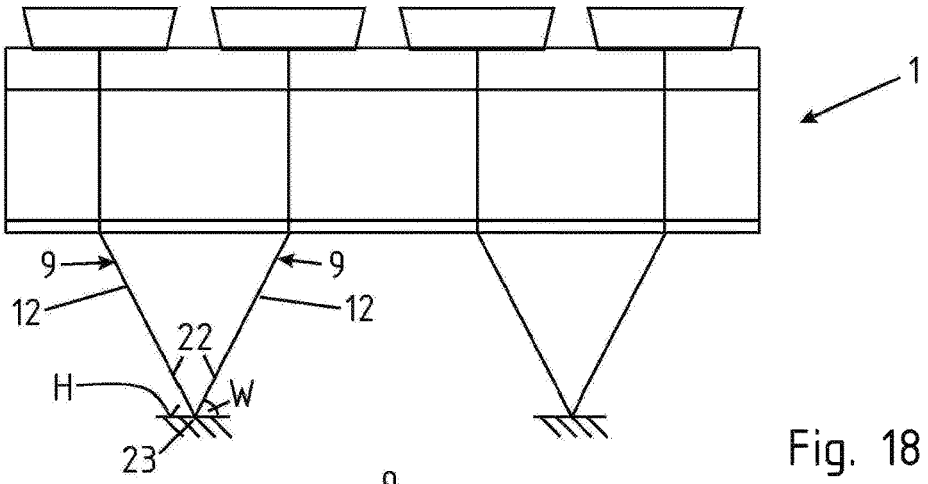
FIG. 18 shows the installation of FIG. 17 in a second view.
Figure 19:
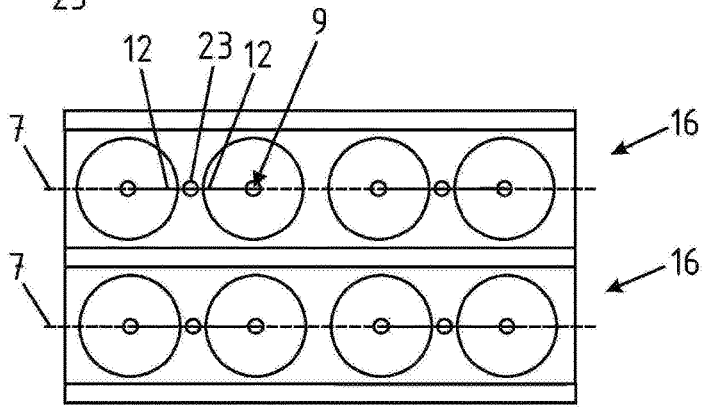
FIG. 19 shows the installation of FIGS. 17 and 18 in a plan view from above.

By contrast to this, the exemplary embodiment of FIG. 17 shows that the support pillars 9 are, in a viewing direction toward the face sides of the individual rows 16, arranged at a 90° angle W1 with respect to the horizontal plane H. FIG. 17 shows that the lower sections 12 of the support pillars 9 enclose with the horizontal plane H an angle W (FIG. 18) which deviates from 90°, and as in the exemplary embodiment of FIG. 14, said lower sections converge in a common foundation 23. FIG. 19 shows that said foundations 23 are situated directly below the respective vertex 7 of the rows 16 of modules 14. In the case of this arrangement, too, only four central foundations 23 are required for the mounting of a total of eight modules 14.

Figure 20:
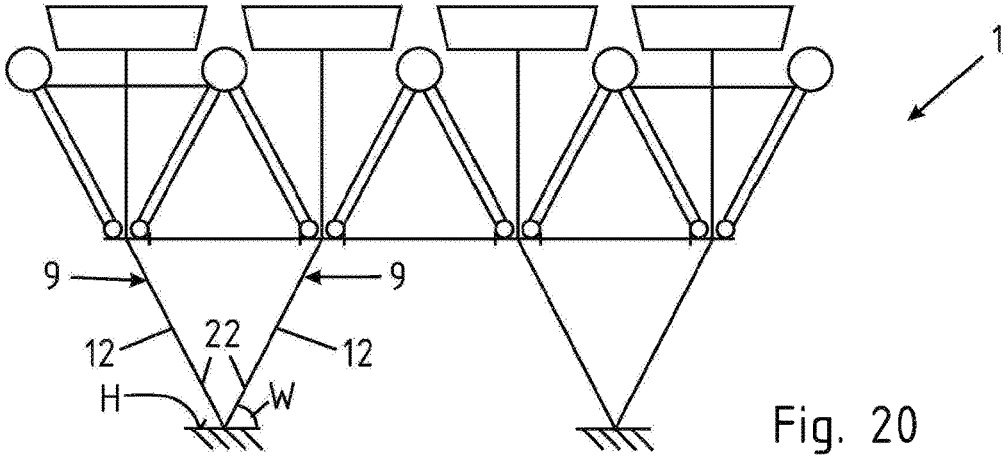
FIG. 20 is a schematic illustration of a further embodiment of an installation for condensing steam in a first side view.
Figure 21:
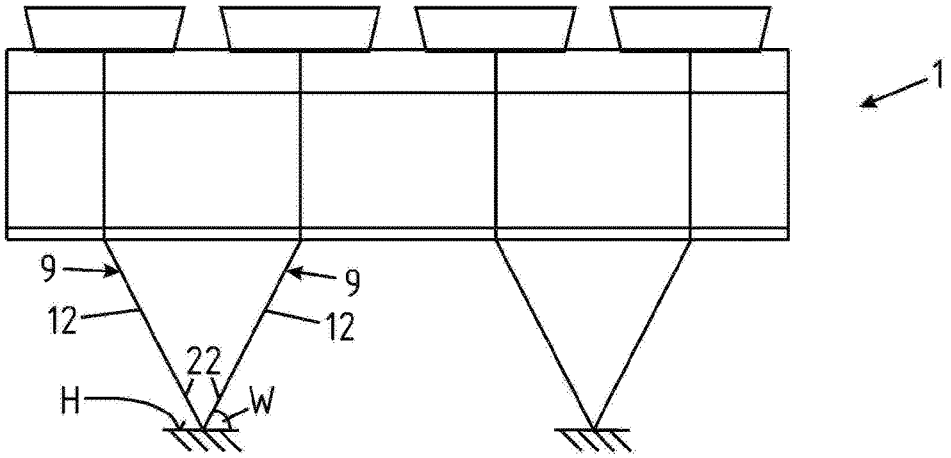
FIG. 21 shows the installation of FIG. 20 in a second view.
Figure 22:
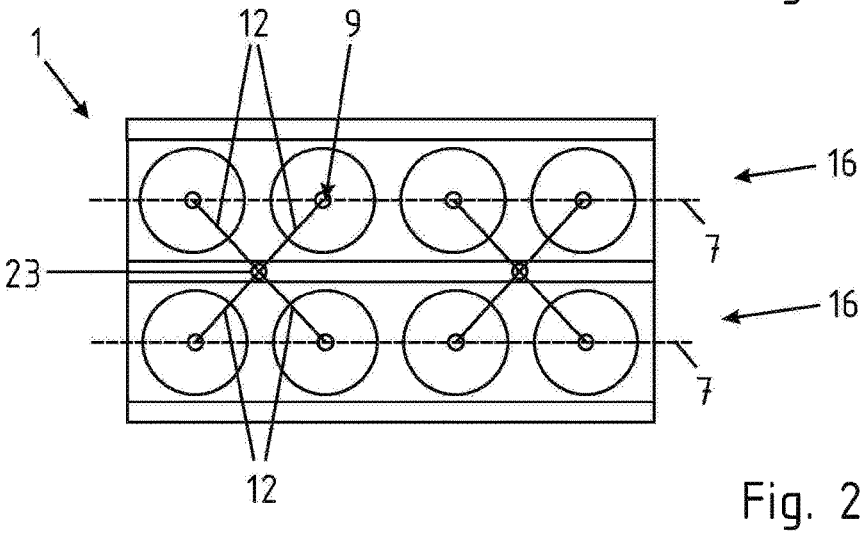
FIG. 22 shows the installations of FIGS. 20 and 21 in a plan view from above.

Finally, FIG. 20 shows an exemplary embodiment in which the support pillars 9, by means of their lower ends 22, assume an angle W, which deviates from 90°, relative to the horizontal plane H both in the direction of the vertex 7 and in the direction transversely with respect to the vertex 7. In this way, only a single central foundation 23 is required for four modules 14, as can be seen in FIG. 22. The entire arrangement of FIG. 3 is consequently mounted on only two foundations 23. In the case of arrangements with three or four rows 16, there are inevitably further foundation points, such that the arrangement is made altogether even more stable.

Figure 23:
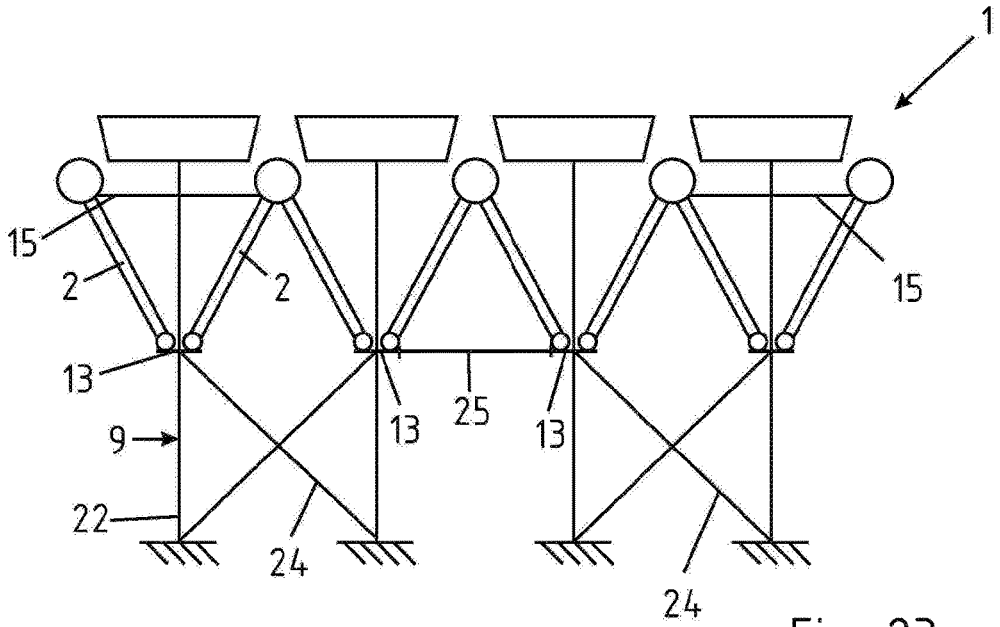
FIG. 23 shows a further embodiment of an installation for condensing steam in a side view.

In FIGS. 14 to 23, additional arrangements of struts for the purposes of stiffening the primary and secondary support structures have not been illustrated. FIG. 23 shows a possible example of how the individual support pillars 9 can be connected by means of lateral struts 24 to adjacent support pillars 9. Said struts 24 may be arranged in crisscrossing fashion and may extend from the lower ends 22 of the support pillars 9 up to or into the region of the support brackets 13. Together with struts 15 in the upper region of the tube bundles 2 and struts 25 in the region of the support brackets 13, an assembly stiffened in the manner of a framework is realized which can accommodate even high lateral wind loads with relatively little material outlay.

Figure 24:
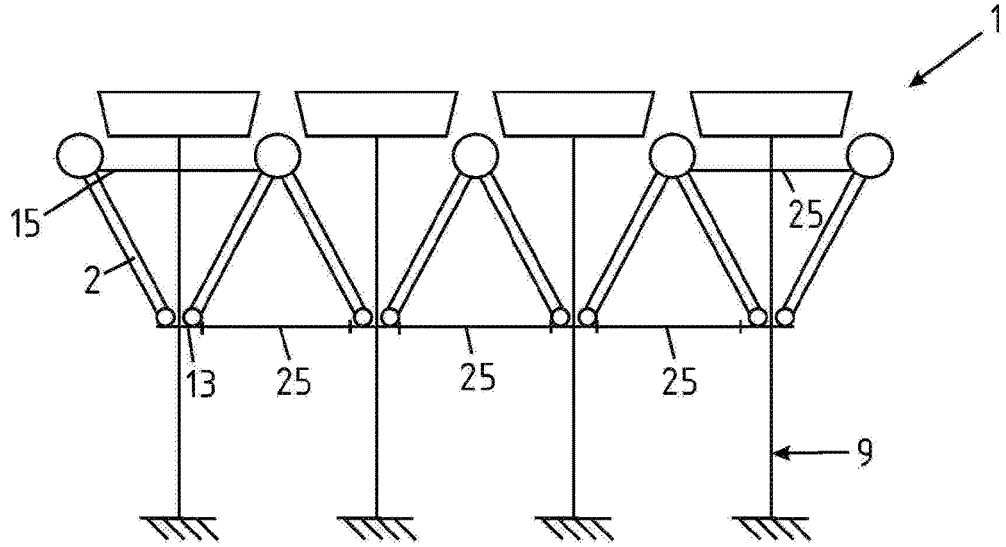
FIG. 24 shows a further embodiment of an installation for condensing steam in a side view.

FIG. 24 shows an alternative exemplary embodiment which dispenses with the crisscrossing struts 24 (FIG. 23). Struts 15 are provided in the upper region of the tube bundles 2 and additional horizontal struts 25 are provided in the region of the support brackets 13. The horizontally acting struts 25 and the self-supporting tube bundles 2 give rise, owing to the triangular arrangement, to a torsion-resistant framework which can accommodate very high loads.

Figure 25:
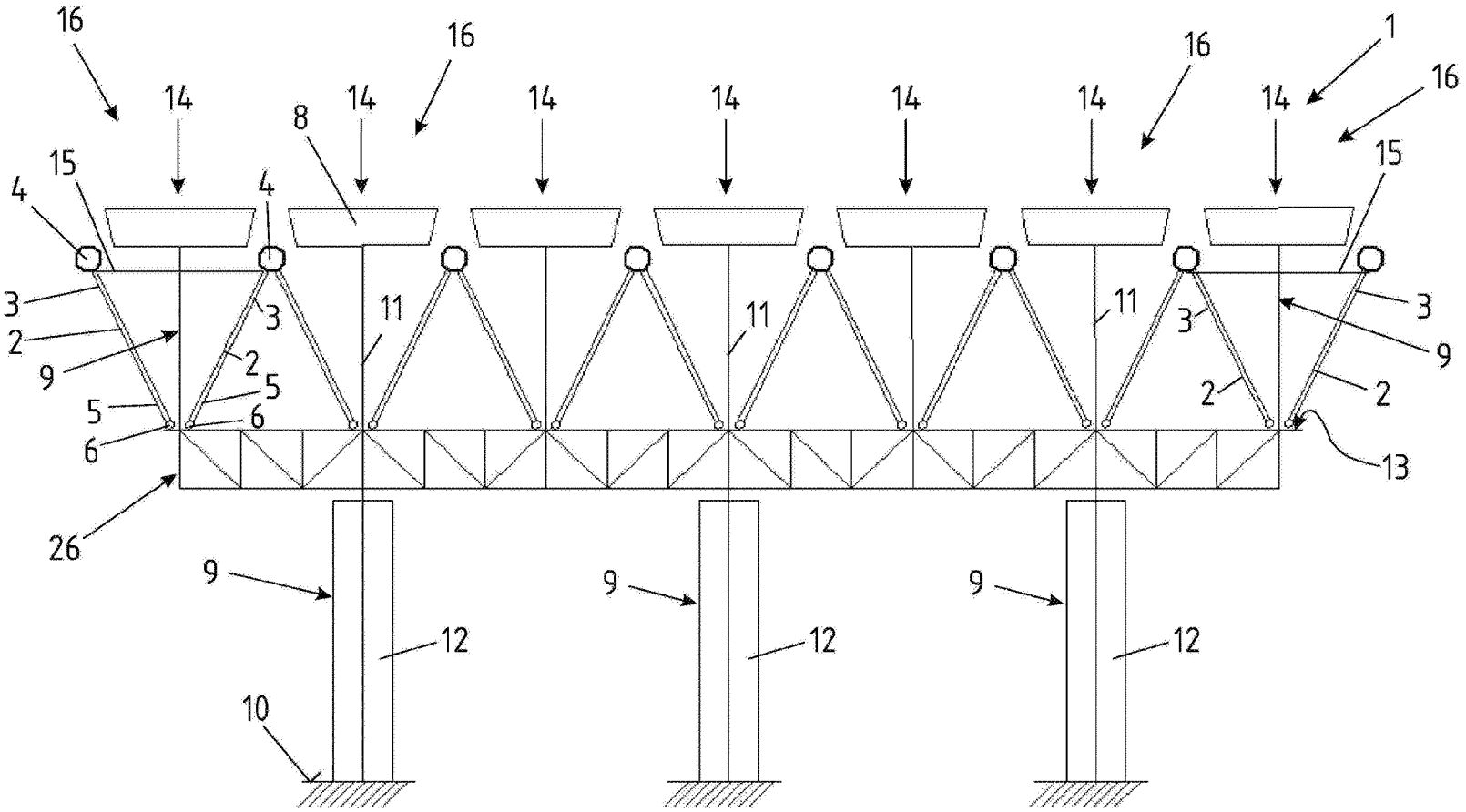
FIG. 25 shows a further embodiment of an installation for condensing steam in a side view.

FIG. 25 shows an embodiment in which an additional crossmember 26 is arranged transversely with respect to the rows of modules 14. The crossmember 26 extends under all of the modules 14. It belongs to the primary support structure. It is situated at the level of the support brackets 13. The support brackets 13 extend, as in the other exemplary embodiments, in the direction of the vertex 7 and thus into the plane of the drawing. In this schematic illustration, the support brackets 13 are situated on the upper edge of the crossmember 26. The supports 9 of every second module 14 extend through the crossmember 26. The supports 9 of the other modules 14 have only an upper section 11. The supports 9 of the rows 16 at the edges have no lower section. The rows 16 at the edges are, by means of the crossmember 26, borne by the supports 9 of the adjacent, inner row 16. Therefore, for a total of seven rows 16, only three supports 9 with lower sections 12 which project as far as the placement surface 10 are required.

In a manner which is not illustrated in any more detail, the tube bundles 2 are configured such that the installation 1 comprises at least one codirectional-flow condenser in which steam and condensate flow in the same direction and at least one counterflow condenser (reflux condenser) in which the condensate flows counter to the steam. The counterflow condenser is connected to an upper suction chamber.

The foregoing description of some embodiments of the invention has been presented for purposes of illustration and description. It is not intended to be exhaustive or to limit the invention to the precise form disclosed, and modifications and variations are possible in light of the above teachings or may be acquired from practice of the invention. The specifically described embodiments explain the principles and practical applications to enable one ordinarily skilled in the art to utilize various embodiments and with various modifications as are suited to the particular use contemplated. It is intended that the scope of the invention be defined by the claims appended hereto, and their equivalents. Further, it should be understood that various changes, substitutions and alterations can be made hereto without departing from the spirit and scope of the invention as described by the appended claims.

The invention claimed is:

1. An installation for condensing steam, comprising:

two tube bundles connected by means of their upper ends to steam distribution lines for the introduction of steam into the tube bundles and are connected by means of their lower ends to condensate collectors for receiving condensate from the tube bundles;

the tube bundles are arranged in V-shaped fashion such that the steam distribution lines of a pair of tube bundles run with a greater spacing to one another than the condensate collectors of the pair of tube bundles, such that the condensate collectors are arranged in the region of a lower vertex of the V-shaped arrangement;

above the pair of tube bundles, at least one aspirating fan is arranged in the region between the steam distribution lines;

the fan is borne by a central support pillar which extends from the fan to the vertex;

the tube bundles are mounted on a support bracket which extends in the longitudinal direction of the vertex and which is connected to the central support pillar;

the tube bundles are self-supporting.

2. The installation for condensing steam as claimed in claim 1, wherein the central support pillar extends vertically below the fan as far as the support bracket.

3. The installation for condensing steam as claimed in claim 1, wherein the central support pillar has a lower section which extends from below the support bracket to a placement surface of the installation.

4. The installation for condensing steam as claimed in claim 1, wherein, in the case of multiple rows of tube bundles in a V-shaped arrangement, mutually adjacent tube bundles are connected by means of their upper ends to a common steam distribution line.

5. The installation for condensing steam as claimed in claim 1, wherein support pillars which are adjacent in a longitudinal direction of the vertex and/or support pillars of mutually adjacent V-shaped tube rows run, below the support brackets and at least over a subregion of their length, at an angle (W) which deviates from 90° with respect to a horizontal plane (H).

6. The installation for condensing steam as claimed in claim 5, wherein adjacent support pillars which run obliquely at least in sections below the support brackets are mounted on a common foundation.

7. The installation for condensing steam as claimed in claim 6 of two adjacent oblique support pillars or, in the case of multi-row installations, groups of four adjacent oblique support pillars, are mounted on a common foundation.

8. The installation for condensing steam as claimed in claim 7, wherein adjacent support pillars and/or tube bundles and/or support brackets are connected to one another by means of struts.

9. The installation for condensing steam as claimed in claim 8, wherein the support bracket is held by bearing means which extend from the support pillar to the support bracket situated at a lower level.

10. The installation for condensing steam as claimed in claim 9, wherein, on the support bracket, there is arranged a self-supporting support structure which, separately from the support pillar, bears the weight of a fan ring.

11. The installation for condensing steam as claimed in claim 1, wherein the support pillars and/or the support brackets are formed at least partially by lattice girders.

12. The installation for condensing steam as claimed in claim 1, characterized in that the support pillar is at least partially of tubular form.

13. The installation for condensing steam as claimed in claim 12, wherein the support pillar has or forms a duct for conducting cooling air from bottom to top to a drive unit of the fan.

14. The installation for condensing steam as claimed in claim 13, wherein a blower is provided for conveying the cooling air through the duct by suction or pressure action.

15. The installation for condensing steam as claimed in claim 14, wherein multiple adjacent rows of mutually adjacent tube bundles are mounted in a V-shaped arrangement on at least one crossmember which extends transversely with respect to the vertex, wherein the crossmember is mounted on at least one support pillar and/or at least one crossmember support.

16. The installation for condensing steam as claimed in claim 15, wherein the number of support pillars and/or crossmember supports which bear the crossmember is smaller than the number of rows borne by the crossmember.

* * * * *